United States Patent [19]

Saitoh et al.

[11] Patent Number: 4,477,195

[45] Date of Patent: Oct. 16, 1984

[54] ARRANGEMENT OF ANALOG-TYPE ELECTRONIC WRISTWATCH

[75] Inventors: Mitsuo Saitoh; Yasuo Kamiyama; Mitsuhiro Murata, all of Tanashi, Japan

[73] Assignee: Citizen Watch Company Limited, Tokyo, Japan

[21] Appl. No.: 247,038

[22] Filed: Mar. 24, 1981

[30] Foreign Application Priority Data

Apr. 1, 1980 [JP] Japan ..... 55-42110

[51] Int. Cl.[3] ..... G04C 23/02

[52] U.S. Cl. ..... 368/88; 368/203; 368/204

[58] Field of Search ..... 368/76, 80, 88, 155, 368/156, 157, 160, 203, 204, 220, 223; 361/398, 401

[56] References Cited

U.S. PATENT DOCUMENTS

| | | | |
|---|---|---|---|
| 4,095,412 | 6/1978 | Burke | 361/398 |
| 4,143,507 | 3/1979 | Ganter et al. | 368/159 |
| 4,196,577 | 4/1980 | Ohno et al. | 368/88 |
| 4,241,436 | 12/1980 | Bolzt et al. | 368/88 |
| 4,249,251 | 2/1981 | Wuthrich | 368/220 |
| 4,272,838 | 6/1981 | Kasama et al. | 368/84 |
| 4,351,040 | 9/1982 | Aoki | 368/88 |
| 4,392,748 | 7/1983 | Yoshino | 368/157 |

*Primary Examiner*—Bernard Roskoski

*Attorney, Agent, or Firm*—Jordan and Hamburg

[57] ABSTRACT

An analog-type electronic wristwatch structure, in which a main plate is made of an insulating material and has one side including a first area formed with a cutout, and second and third areas. A wheel train bridge is secured to one side of said main plate above said cutout to form therein a space, and a wheel train mechanism is disposed in said space. A flexible circuit board is disposed in the second area of said main plate and has its lower surface facing said main plate, said lower surface being provided with a printed circuit pattern. The flexible circuit board carries electronic components composed of at least a time base vibrator and an IC chip. An electromechanical transducer drive coil is disposed in the third area of said main plate. The main plate has recesses for accommodating at least portions of said electronic components.

7 Claims, 8 Drawing Figures

POWER SUPPLY CONTROL CIRCUIT 44
DOWN CONVERTER CIRCUIT
CONSTANT-VOLTAGE CIRCUIT
OSC CIRCUIT
FREQUENCY DIVIDER
WAVEFORM CONVERSION CIRCUIT
INTERFACE CIRCUIT
DRIVE CIRCUIT
DIVIDING RATIO SETTING CIRCUIT
1Hz
R
S
VDDH
VDDL
Vss
28
30
32
34
36
38
40
42
44a
44b
46
48
50
52
54
24

ARRANGEMENT OF ANALOG-TYPE ELECTRONIC WRISTWATCH

BACKGROUND OF THE INVENTION

This invention relates to an analog-type electronic wristwatch structure that is capable of being manufactured at low cost. More particularly, this invention seeks to provide an analog-type electronic wristwatch structure which is simplified by adopting a synthetic resin material to form a main plate, which constitutes a principal base plate forming part of a timepiece movement, and by employing a flexible printed circuit board, having a thickness of from 60 to 300 microns, as a circuit board for forming an electronic circuit block.

Analog-type crystal wristwatches have achieved popularity with comparative rapidity in recent years. These wristwatches are composed of such components as a crystal oscillator circuit serving as a time base oscillator, a frequency divider circuit which divides a high-frequency time base signal, produced by the oscillator circuit, down to a low-frequency unit time signal, a driver circuit which produces drive signals upon receiving the unit time signal produced by the frequency divider circuit, an electro-mechanical transducer, such as a stepping motor, driven in response to the drive signal from the driver circuit, a mechanical transmission mechanism such as a wheel train driven by the electro-mechanical transducer, hands which are advanced in accordance with the operation of the mechanical transmission mechanism, time correction means for correcting the time displayed by the hands, and a power supply battery for supplying the oscillator circuit, frequency divider circuit, driver circuit and electro-mechanical transducer with electrical energy.

The conventional analog-type crystal wristwatches have a main plate which generally consists of a metal material, the main plate serving as a principal base plate forming part of the timepiece movement. In providing the main plate with a shape called for by its functional characteristics, therefore, it is necessary to rely upon an extremely time-consuming machining method to cut the plate. This is one major obstacle to reducing costs.

On the other hand, flexible printed circuit boards having a thickness of from 60 to 300 microns have come into use as circuit boards, enabling large quantities of electronic circuit blocks to be mounted in continuous fashion. Such circuit mounting techniques, referred to as mini-MOD or film-carrier mounting techniques, have undergone rapid development in recent years and now make it possible to manufacture electronic circuit blocks for timepieces at extremely low cost. When a flexible printed circuit board is employed as the circuit board in an analog-type electronic wristwatch, however, a special reinforcing arrangement is called for because the printed circuit board itself does not have adequate mechanical strength. Since such an arrangement raises cost, there has in fact been a growing tendency away from the use of the flexible printed circuit board. More specifically, in the case of wristwatches, there is always the danger of an externally applied impact when the wristwatch is being worn, owing to the very nature of the commodity, so that such a commodity must have impact resistance. It is obvious that preventing major accidents, such as damage to the electronic circuit block, will be difficult unless sufficient protection against externally applied impact is provided for the electrical elements mounted on the printed circuit board, and for portions where connections exist between these elements and the circuit board. A flexible printed circuit board can be fixed and protected against externally applied impacts or the like with relative ease in the case of a digital-type electronic wristwatch which does not have a miniature moving portion such as a wheel train, and which is so constructed as to enable the circuit board to be embraced from above and below, over a wide area, by means of the electro-optical display cell and such members as a display cell supporting member or element cover. In the case of the analog-type electronic wristwatch, however, providing such protection for the flexible printed circuit board and for the electrical elements mounted on the board entails more than just a special arrangement. It requires additionally that special consideration be given to a fixing structure in the conventional case where the main plate, comprising the principal base plate, is composed of a metallic material. This is because electrical short circuits must not be allowed to occur owing to contact between the main plate and the conductive pattern or electrical elements on the printed circuit board. There is also an additional structural requirement in order to effect electrical interconnection between other components, such as battery lead members, and portions of the electrically conductive pattern provided on the flexible printed circuit board. Since the flexible board has none of the rigidity necessary for bearing the contact pressing forces exerted by such members as battery lead members, special connector members and a fastening arrangement become essential to couple the board and other members together for the purpose of maintaining stable electrical connection between them.

Adopting the flexible printed circuit board is an extremely effective measure for the low-cost manufacture of the electronic circuit blocks per se. Nevertheless, when the flexible printed circuit board is employed as the circuit board for constructing the electronic circuit block in an analog-type electronic wristwatch in accordance with the prior art, special members for protection, reinforcement, insulation and fixing must added in order to protect the electronic circuit block, to prevent short circuits and to stabilize the electrical interconnection among members. When the total cost for the manufacture of the entire timepiece is considered, adopting the flexible printed circuit board is not found to be an effective expedient for reducing such cost.

SUMMARY OF THE INVENTION

Accordingly, an object of the present invention is to provide a novel arrangement for a timepiece movement, wherein it is possible to eliminate special members for protection, reinforcement, insulation and fixing and the like, by adopting a synthetic resin main plate capable of manufacture at low cost, and an electronic circuit block that employs a flexible printed circuit board similarly capable of manufacture at low cost, and by functionally combining the features of each of these two members.

DESCRIPTION OF THE PREFERRED EMBODIMENT

Figure 1:
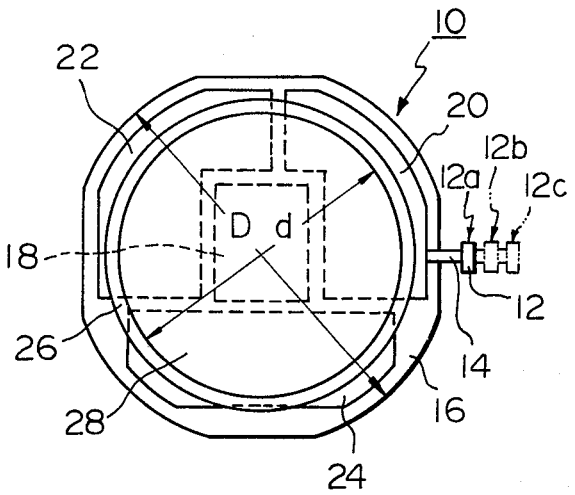
FIG. 1 is a plan view showing, in simplified form, an arrangement in which the movement of an analog-type crystal wristwatch embodying the present invention is seen from the back cover side of the timepiece.

FIG. 1 is a plan view showing, in simplified form, an arrangement in which the movement of an analog-type crystal wristwatch embodying the present invention is seen from the back cover side of the timepiece. Specifically, a timepiece 10 according to this embodiment has a crown 12, fixed to an operating shaft (referred to as a time setting stem below) 14, serving as an external operation member for correcting the time displayed by means of hands. The crown 12 is so adapted as to be positioned stably at a normal position 12*a*, or at a position 12*b* one step removed (by pulling), or at a position 12*c* two steps removed (by pulling) by means of a setting lever and a clutch lever forming part of a time correction mechanism which will be described below, the positions 12*a*, 12*b*, 12*c* being located along the axis of the time setting stem 14. A main plate 16 is formed of a synthetic resin as an insulating material and has a central area, and first to third areas surrounding the central area. A wheel train mechanism 18 composed of the major portion of a wheel train bridge and a series of wheels to be described later is disposed in the central area of the main plate. A time correction mechanism 20, an electronic circuit block 22 and a stepping motor 24 serving as an electro-mechanical transducer are disposed in first to third areas, respectively, outside the wheel train mechanism 18. A battery receiving member 26 made of synthetic resin and a coin-type lithium battery 28 are stacked, in the order mentioned, on the wheel train mechanism 18, the time correction mechanism 20, the electronic circuit block 22 and the stepping motor 24, the battery receiving member and the battery being so arranged as to conver the major portions of these elements. It should be noted that the wristwatch in this embodiment is a men's watch, that the maximum diameter D of the main plate 16 falls within a range given by $23 \leqq D \leqq 28$ millimeters, and that the diameter d of the lithium battery 28 falls within the range given by $16 \leqq d \leqq 25$. Hence, the ratio of the diameter d of the battery 28 to the maximum diameter D of the plate 16 falls within the range given by $0.65 \leqq d/D \leqq 0.95$. In other words, this range of values for d/D has been selected as the most suitable in view of accommodations for a battery having as large an energy capacity as possible, in view of an appropriate arrangement of various parts for retaining the battery reliably, and finally, in view of an arrangement of parts that allows the timepiece movement to be adjusted and operated simply with the battery in place.

Figure 2:
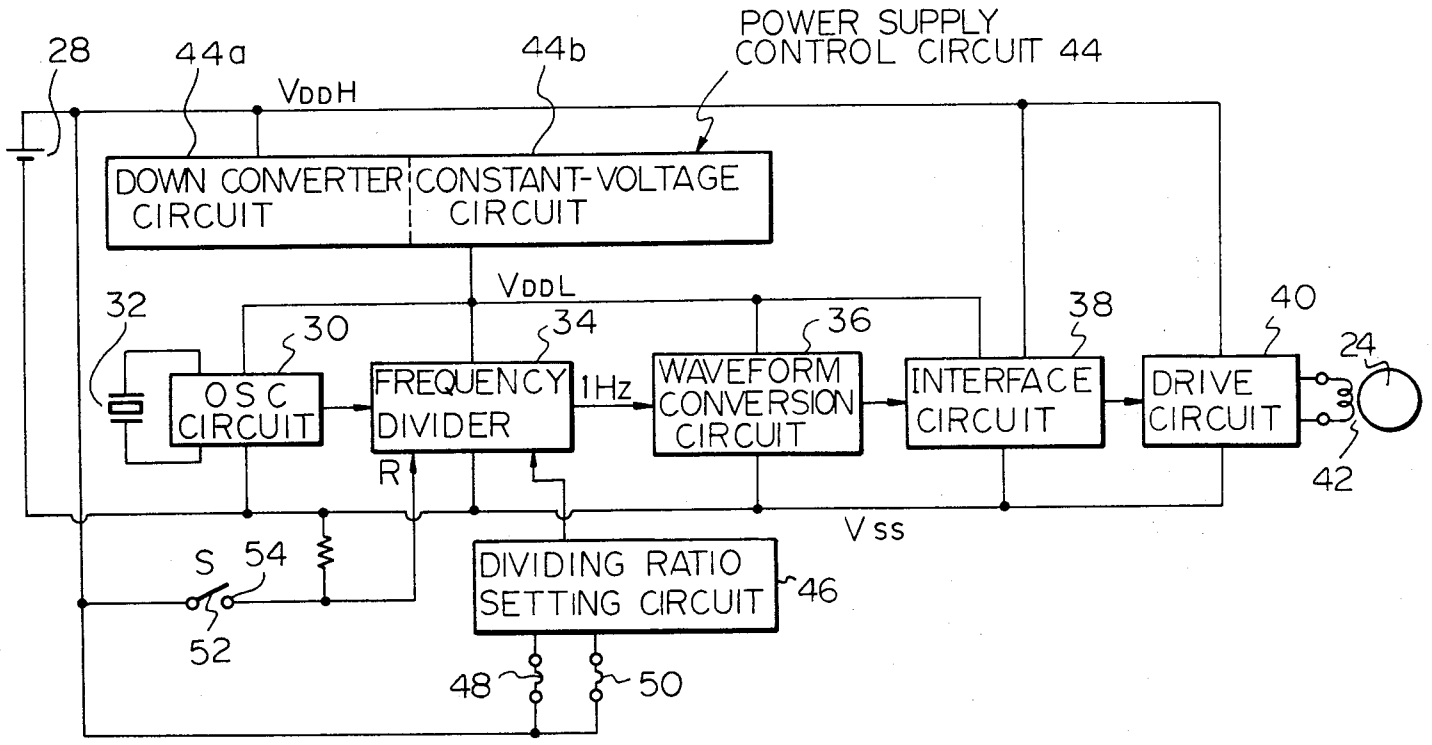
FIG. 2 is a block wiring diagram showing, in simplified form, the circuitry of a timepiece according to this embodiment.

FIG. 2 is a block wiring diagram showing, in simplified form, the circuitry of a timepiece according to the present embodiment. A crystal oscillator circuit 30 is equipped with a tuning fork crystal vibrator 32 serving as a time base vibrator. A high-frequency time base signal, having a frequency of 32 Hertz and produced by the oscillator circuit 30, is divided down to a 1-Hertz time unit signal by a frequency divider circuit 34. The 1-Hertz time unit signal is subjected to a pulse-width conversion by means of a waveform conversion circuit 36 and is then applied to a motor drive circuit 40 through an interface circuit 38. A stepping motor 24 is driven in response to a drive signal produced by the drive circuit 40.

In accordance with this embodiment, the power supply battery adopted is a lithium battery 28 whose characteristics are such that a large electromotive force is provided with only a slight decline in the stability of the voltage value in comparison with a silver battery. Hence, in order to supply the electrical energy efficiently and stably, the timepiece is provided with a power supply control circuit 44 composed of a down-converter circuit 44*a* and a constant-voltage circuit 44*b*. In other words, the voltage $V_{DDH}$ of the lithium battery 28, having a value of approximately 2.8 to 3.0 volts, is stepped down to approximately 1.4 to 1.5 volts by the down-converter 44*a*, while the constant-voltage circuit 44*b* stabilizes the voltage by suppressing fluctuations in the voltage value. The voltage $V_{DDL}$ of approximately 1.4 to 1.5 volts, stabilized by the constant-voltage circuit 44*b*, is supplied to such components as the oscillator circuit 30, frequency divider 34 and waveform conversion circuit 36, and the lithium battery voltage $V_{DDL}$ of approximately 3 volts is supplied directly to the motor drive circuit 40. In other words, the arrangement is such that the voltages applied are different from each other since the oscillator circuit 30 and frequency divider circuit 34 operate satisfactorily even at a low voltage of about 1.3 volts or less, and since it is preferred to drive the stepping motor 24 at a high voltage in order to achieve electro-mechanical conversion at a high efficiency. The interface circuit 38 is provided in order to interconnect the circuits driven by the mutually different voltages. Thus, in accordance with the above construction, it is possible to prevent wasting of electrical energy that would result by supplying the frequency divider circuit 34 and oscillator circuit 30 with a voltage higher than that necessary, and it is possible to drive the stepping motor 24 at a high conversion efficiency.

The timepiece of this embodiment is further provided with a circuit 46 for setting the frequency dividing ratio, which circuit is adapted to regulate the running speed of the timepiece by changing, in small increments, the dividing ratio of the frequency divider circuit 34. Specifically, a portion of a flexible printed circuit board forming part of the electronic circuit block, which will be described later, is provided with a conductive pattern that serves as dividing ratio setting terminals 48, 50 connected to the setting circuit 46. The arrangement is such that cutting the terminals 48, 50 when necessary varies the dividing ratio of the frequency divider circuit 34. By way of example, cutting only the terminal 48 adds about 15 seconds per month, cutting only the terminal 50 subtracts about 15 seconds permonth, and cutting both terminals 48, 50 adds about 30 seconds per month, thereby allowing the running speed of the timepiece to be changed.

A reset switch mechanism S is composed of a clutch lever 52 serving as a reset lever, and a reset terminal 54 provided on a portion of the printed circuit board. When the crown 12 is pulled out two steps to the position 12*c* to correct the time indicated by the timepiece hands, the clutch lever 52, which is operatively coupled to the crown, makes contact with the reset terminal 54 to close the reset switch mechanism S. The arrangement is such that closing the switch mechanism S places at least a portion of the frequency divider circuit 34 in the reset state.

Figure 3:
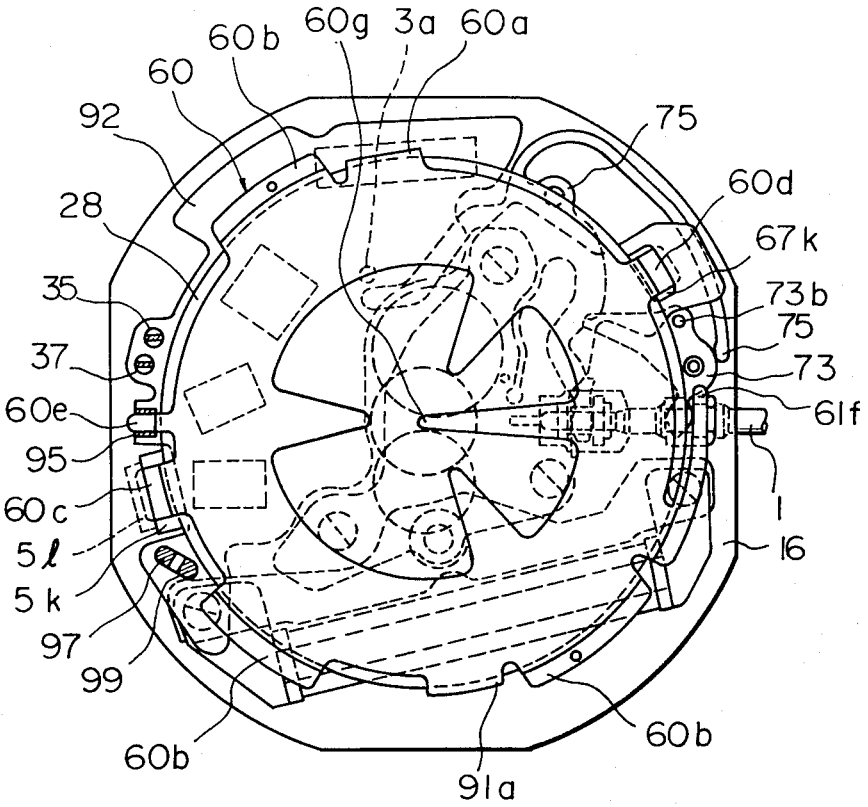
FIG. 3 is a plan view showing, in greater detail, the arrangement when the movement of the timepiece of this embodiment is viewed from the back cover, a battery retaining member being deleted.
Figure 4:
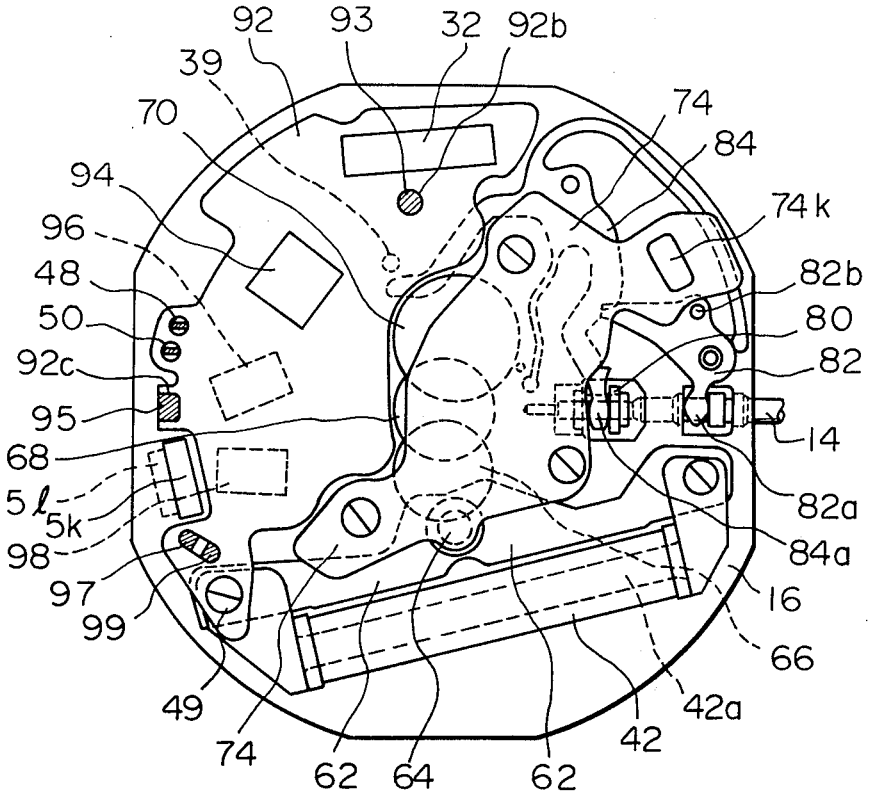
FIG. 4 is a plan view showing the timepiece movement of FIG. 3, from which a battery supporting spring and a coin-type lithium battery have been removed, the battery retaining member being deleted.

FIG. 3 is a plan view showing, in greater detail, the analog-type electronic wristwatch structure when the movement of the timepiece embodying the invention is viewed from the back cover, and FIG. 4 is a plan view showing the timepiece movement of FIG. 3, from which the coin-type lithium battery 28 and a battery retaining spring 60, which will be described later, have been removed. Furthermore, the battery receiving or supporting member 26 mentioned above also is deleted from FIGS. 3 and 4 for the sake of simplicity.

Figure 5A:
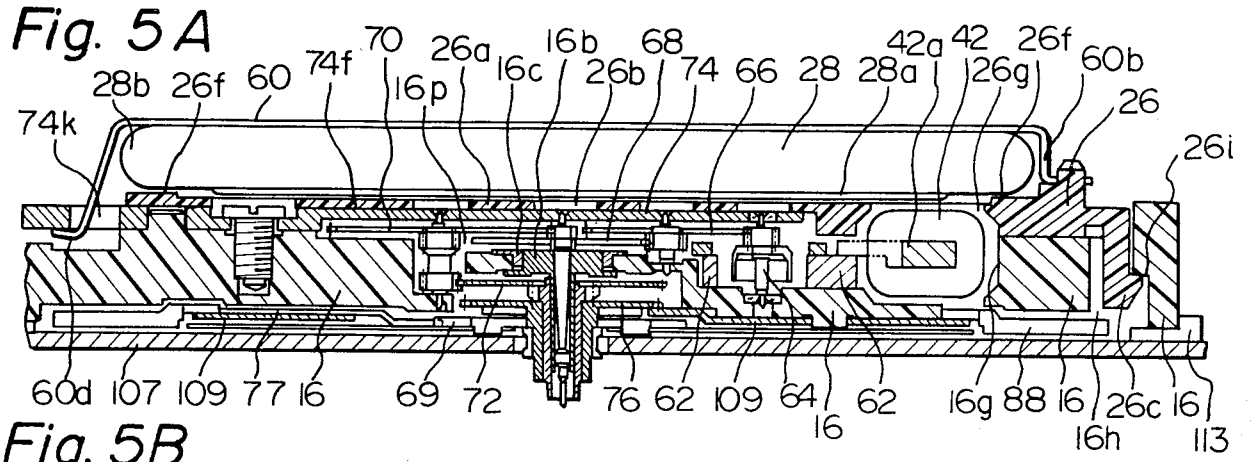
FIGS. 5A and 5B are cross-sectional views showing elements in the mechanical portion of a timepiece movement according to this embodiment, FIG. 5A illustrating primarily a stepping motor and a wheel train driven by the stepping motor, and FIG. 5B illustrating primarily a displayed time correction mechanism.
Figure 5B:
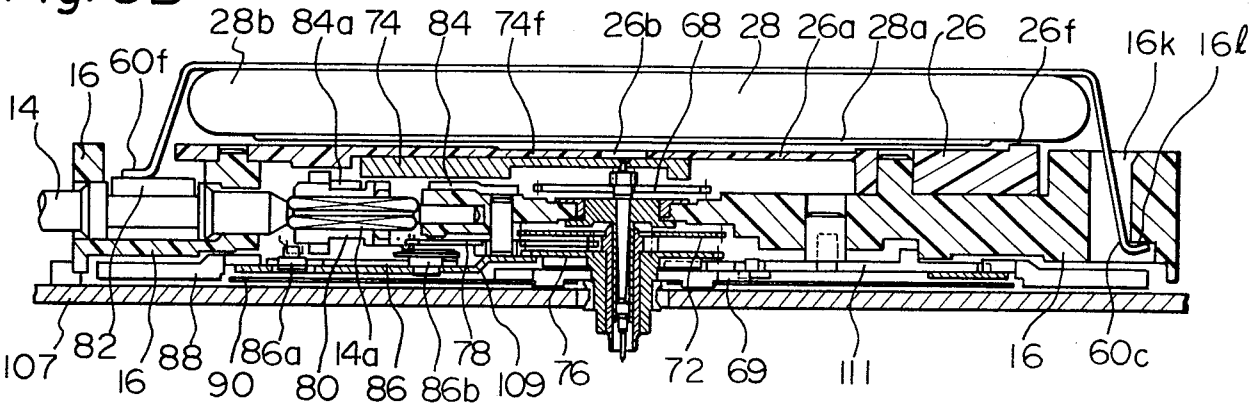
Figure 6A:
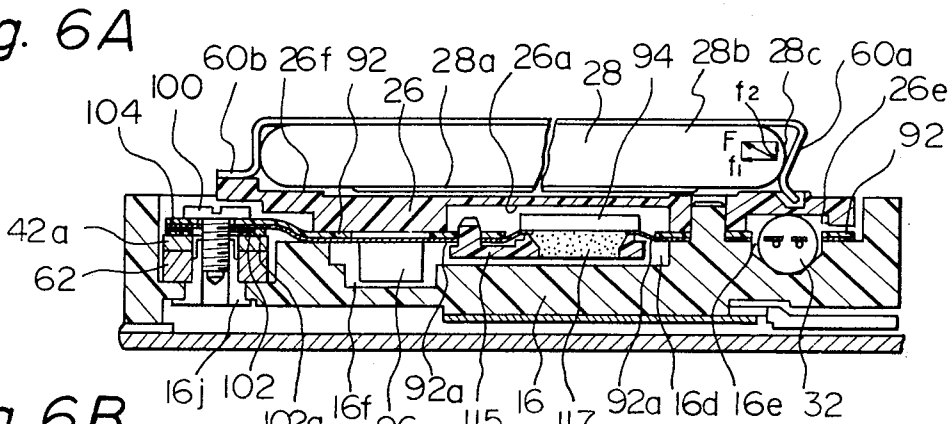
FIGS. 6A and 6B cross-sectional views illustrating the principal portion in the area of the electronic circuit block of the timepiece movement according to this embodiment, FIG. 6A showing mainly the structure of the electronic circuit block per se, and FIG. 6B showing mainly the structure of the electrical interconnection between the electronic circuit block and a coin-type lithium battery.
Figure 6B:
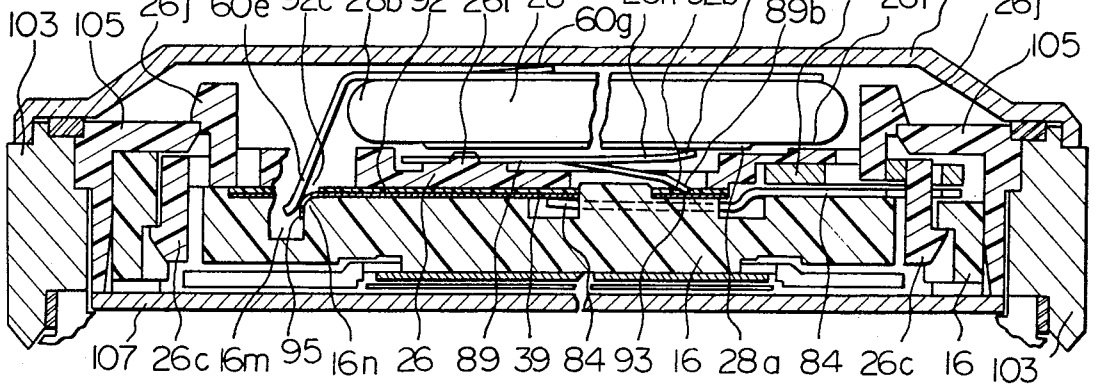

FIG. 5 is a cross-sectional view showing the principal part of the mechanical portion of the timepiece movement in this embodiment, FIG. 5A showing mainly a stepping motor and a train of wheels driven by the stepping motor, and FIG. 5B showing mainly a time correction mechanism. FIG. 6 is a cross-sectional view illustrating the principal portion in the area of the electronic circuit block of the timepiece movement in this embodiment, FIG. 6A depicting mainly the structure of the electronic circuit block per se, and FIG. 6B depicting mainly the structure of the electrical interconnection between the electronic circuit block and the lithium battery 28. FIG. 6B exemplifies also the structure of the timepiece movement received in a case.

Reference will now be had to FIGS. 3 through 6 to describe in detail a timepiece embodying the invention.

The main plate 16 consists of a comparatively hard synthetic resin material, namely polyphenylene sulfide incorporating glass fibers. A coil 42, namely one of the structural elements of the stepping motor 24, is disposed in a coil accommodating cutout or recess 16*g* (FIG. 5A) formed in the third area of the main plate 16. The magnetic core 42*a* of the coil 42 is magnetically coupled to left and right stators 62 forming a pair, and a rotor 64 is so disposed as to be surrounded by the left and right stators. Thus, the coil 42, stators 62 and rotor 64 construct the stepping motor 24. The arrangement is such that the rotor 64, constituting the mechanical output means of the motor 24, drives the train of wheels comprising a fifth wheel 66, fourth (second hand wheel) wheel 68, third wheel 70 and center wheel (minute hand wheel) 72. In other words, the train of wheels comprising the fifth wheel 66, fourth wheel 68 and third wheel 70 are disposed in a cutout 16P of the centeral area of the main plate 16 and, together with the rotor 64, have their upper shafts supported by the wheel train bridge 74 which is made of metal, the train of wheels cooperating with the major portion of the wheel train bridge 74 to construct the wheel train mechanism 18 defined above in connection with FIG. 1.

The center wheel 72 is adapted to transmit driving force to an hour wheel (hour hand wheel) 76 through a minute wheel 78, with the center wheel 72, minute wheel 78 and hour wheel 76 forming a so-called setting wheel train. Second, minute and hour hands mounted on respective ones of the fourth, center and hour wheels 68, 72, 76 are deleted from the drawings. The center wheel 72 is supported by a center supporting shaft 16*b* made of metal, the latter being reliably secured to the main plate 16 through a metal washer 16*c*. To be more specific, a portion of the center supporting shaft 16*b* is press-fitted and secured in the hole of the washer 16*c* so as to tightly embrace the main plate 16 between their large diameter portions. This structure prevents the center supporting shaft 16*b* from falling out of the main plate 16.

The clutch wheel 80 is fitted over an angular portion 14*a* of the setting stem 14 and rotates in unison with the setting stem 14 when the crown 12 is turned. One end 82*a* of the setting lever 82 is in engagement with a recess formed in the setting stem 14, and the clutch lever 84 is in engagement with the setting lever 82. Further, one end 84*a* of the clutch lever 84 is engagement with a recess formed in the clutch wheel 80. Accordingly, the setting lever 82 and clutch lever 84 are interlocked and hence move together with respect to axially directed movement of the setting stem 14 secured to the crown 12. As a result, the axial position of the clutch wheel 80 can be changed. More specifically, when the crown 12 is pulled out two steps to the position 12*c* shown in FIG. 1, the clutch wheel 80 is shifted to a position where it is in direct meshing engagement with the minute wheel 78, this occurring owing to the action of the setting lever 82 and clutch lever 84. Thus, when the crown 12 is turned under these conditions, it is possible to effect a correction of the time indicated by the hands of the watch. Furthermore, when the crown 12 is pulled out by one step, the clutch wheel 80 is shifted to a position where it engages with a portion 86*a* of a calendar correcting lever 86. The construction is such that when the crown 12 is turned under these conditions, either a date wheel 88 or day wheel 90 is driven, depending upon the direction in which the crown is turned. When the crown 12 is in the normal position 12*a*, the clutch wheel 80 is retained at a position where it engages with neither the minute wheel 78 nor the calendar correcting lever 86. The setting lever 82 and clutch lever 84 described above are disposed on the main plate 16 at the upper right-hand portion thereof as depicted in FIG. 4, and construct a portion of the displayed time correction mechanism defined above in connection with FIG. 1. A portion of the wheel train bridge 74 is extended over portions of the setting lever 82 and clutch lever 84 and acts to positionally restrain these levers against upward movement.

A flexible printed circuit 92 having a thickness of from 60 to 300 millimeters is employed as a circuit board for constructing the circuit block 22 in the timepiece of this embodiment. The printed circuit board 92 is provided on one side with a densely arranged conductive pattern 92*a* (FIG. 6A) comprising a thin sheet of metal such as copper foil.

Mounted at prescribed locations on the printed circuit board 92 are electrical elements such as an IC chip 94, tuning fork-type crystal vibrator 32 and chip capacitors 96, 98. These electrical elements are electrically interconnected by the conductive pattern 92*a*. The printed circuit board 92 is placed directly on the main plate 16 with the conductive pattern-bearing surface of the circuit board facing downward. The main plate 16 is, therefore, provided with electrical element accommodating recesses 16*d*, 16*e*, 16*f* and the like, so formed as to receive at least portions of the IC chip 94, crystal vibrator 32, and chip capacitor 96 and the like. In other words, by forming the main plate 16 of a synthetic resin insulator and by providing it with recesses for receiving those portions of the electrical elements that project from the printed circuit board 92, it becomes possible to set the circuit board 92 on the main plate 16, as it stands, in the manner described above. Adopting this structure completely eliminates such dangers as short circuits between portions of the conductive pattern 92*a* and electrical elements provided on the printed circuit board 92 owing to contact with other electrically conductive members. It also protects the electrical elements by virtue of the walls defining the recesses 16*d*, 16*e*, 16*f* in the main plate 16. Hence, it is obvious that special insulating parts and electrical element protecting parts need not be provided between the printed circuit board 92 and main plate 16. It should be noted that the IC chip 94 has a monolithic structure which is provided with the oscillator circuit 30, the frequency divider circuit 34, waveform conversion circuit 36, interface circuit 38, motor drive circuit 40, a portion of the down-converter circuit 44*a*, the constant-voltage circuit 44*b*, and the dividing ratio setting circuit 46, all of which are shown in FIG. 2. The capacitors 96, 98 constitute a portion of the down-converter circuit 44*a*. The electrical elements such as the crystal vibrator 32, IC chip 94 and capacitors 96, 98, which are mounted on the circuit board 92, are disposed on the main plate 16 at locations thereof that completely avoid (when viewed in plan) the spaces occupied by the fifth wheel 66, fourth wheel 68 and third wheel 70 forming the wheel train mechanism 18. The printed circuit board 92 is disposed so as to be substantially flush with the gear portion of the fourth wheel 57, and is arranged on the main plate 16 so as to avoid completely (when viewed in plan) the space occupied by the wheel train mechanism 18 composed of the fifth wheel 66, fourth wheel 68, third wheel 70 and the major portion of the wheel train bridge 74.

A supporting pillar 16*j* penetrates a portion of the main plate 16, as shown in FIG. 6A. The stator 62, coil core 42*a* and one end of the printed circuit board 92, stacked on the main plate 16 in the order mentioned, are secured by a screw 100 while they are positioned by the supporting pillar 16*j*. In this case a terminal-processed sheet 102 is bonded to the coil core 42*a* on the upper side thereof. The terminal-processed sheet is equipped with a pair of coil terminal connecting conductive patterns 102*a* that are electrically coupled to the winding terminals of the coil 42. Moreover, a pair of motor drive terminals 104 are provided, as a portion of the conductive pattern 92*a*, on the lower side of the printed circuit board at one edge portion thereof. Thus, the flexible printed circuit board 92 is secured with the drive terminals 104 superimposed on the coil terminal connecting patterns 102*a*, with the result that the electronic circuit block 22 and the coil 42 of the stepping motor are brought into electrical communication.

Placed on the main plate 16 and the wheel train bridge 74 is the battery receiving member 26 that consists of a comparatively soft synthetic resin material. Placed atop the battery receiving member 26 is the coin-type lithium battery 28 retained by a battery retaining spring 60 serving as the battery retaining member. That portion of the battery receiving member 26 comparatively near the center of the timepiece movement defines a wheel train bridge covering portion 26*a* carried atop the wheel train bridge 74. The covering portion 26*a* is formed to include through-holes 26*b* at locations corresponding to the wheel train bearing portions in such a manner as to permit the bearing portions to be lubricated and visually inspected with ease. Portions of the battery receiving member 26 relatively near the outer peripheral portion thereof are carried directly on the main plate 16, and portions thereof positioned over the electronic circuit block 22 function to press down and secure the flexible circuit board 92 against the main plate 16. In this case, portions of the battery receiving member 26 also are formed to include electrical element accommodating recesses 26*d*, 26*e* and the like for receiving at least portions of the electrical elements such as the IC chip 94 and crystal vibrator 32 that are mounted on the printed circuit board 92. The end result is that these electrical elements mounted on the printed circuit board 92 are accommodated in the recesses formed in the main plate 16 and battery receiving member 26 so that the elements are protected by the main plate and battery receiving member. Further, a portion of the battery receiving member 26 is formed to include also a coil accommodating hole 26*g* for accommodating the upper portion of the coil 42, the arrangement being such that said upper portion is protected by the battery receiving member as well. Resilient hook portions 26*c*, formed integrally with the battery receiving member 26 near the outer peripheral portion thereof, serve as engaging members for fixedly attaching the battery receiving member 26 to the main plate 16. The resilient hook portions 26*c* are adapted to be inserted into through-holes 26*h* provided in the main plate 26, and to resiliently engage step portions 26*i* provided in the through-holes 26*h*. More specifically, in attaching the battery receiving member 2 to the main plate 16, the resilient hook members 16*c* are inserted into respective through-holes 16*h* while undergoing slight inward deflection toward the center of the timepiece movement. Then, upon passing the step portions 16*i*, the hook portions 26*c* return to their original attitude thereby to engage the step portions 16*i*. As a result, the printed circuit board 92 is embraced, from the top and bottom, by the battery receiving member 26 and main plate 16, in which state the printed circuit board 92 and battery receiving member 26 are simultaneously retained on the plate 16 without any special fastening members such as screws.

The coin-type lithium battery 28 is carried atop the battery receiving member 26 with the negative pole 26*a* of the battery facing downward. In this case the battery 26 is, at all times, retained by the battery supporting spring 60 in such a manner as to be disposed with a small clearance between it and the battery receiving member 26 so that it does not abut against the latter member. The battery retaining spring 60 is attached to such structural base plates of the timepiece movement as the main plate 16 and wheel train bridge 74. To be more specific, the battery retaining spring, shaped by subjecting a thin metal plate to pressing work, 60 such as bending and punching, is formed to include a bent portion 60*a* for battery retention, a height-retention portion 60*b*, and anchor portions 60*c*, 60*d*. The bent portion 60*a* serves to retain the battery 28 in a resilient manner, and the height-retention portion 60*b*, by abutting against the upper surface of a portion of the battery receiving member 26 from above the surface, acts to maintain a clearance between the lower surface of the battery 28 and other members in the movement. The anchor portions 60c, 60d are so constructed as to be anchored resiliently in the lower surfaces of the main plate 16 and wheel train bridge 74 when the retaining spring 60 is attached. The battery retaining bent portion 60a is provided at two locations that are substantially symmetrically disposed with respect to the center of the battery 28, as shown in FIG. 3. Moreover, as depicted in FIG. 6A, the bent portion 60a is so constructed as to resiliently press a curved portion 28c on the side surface of the battery 28, the pressing force F having a component $f_1$ parallel to the diameteric direction of the battery, and a component $f_2$ parallel to the thickness direction of the battery. Accordingly, the battery 28 is retained resiliently by the entire retaining spring 60 per se while receiving an upwardly tensioning force owing to the battery retaining bent portion 60a provided at two locations. The anchor portion 60c penetrates a through-hole 16k, provided in the main plate 16 and having a step portion 16l, and is so constructed that a bent portion at the tip thereof engages the step portion 16l, the latter being provided in the bottom surface of the main plate 16. The anchor portion 60d similarly penetrates a hole provided in the wheel train bridge 74, and is so constructed that a bent portion at the tip thereof engages the bottom surface of the wheel train bridge. In other words, in attaching the battery retaining spring 60 to the main plate 16 and wheel train bridge 74 and the like, the anchor portions 60c, 60d are inserted into the respective holes 16k, 74k while being deflected inwardly toward the center of the timepiece movement. Then, when the anchor portions 60c, 60d have returned to their original attitude, the bent portions at the respective tips thereof resiliently engage the bottom surfaces of the step portion 16l and wheel train bridge 74 to firmly secure the retaining spring 60. In accordance with this arrangement, the elastic force acting upon the anchor portions 60c, 60d attempts to pull the battery retaining spring 60 downwardly toward the main plate 16 and wheel train bridge 74, while the height-retention portion 60b, which is formed on a portion of the supporting spring 60, is in abutting contact with the upper surface of the battery receiving member 26. The end result is that the entire battery retaining spring 60 is secured in an attitude whose final position is regulated by the height-retention portion 60b. At least one part of that portion of the battery receiving member 26 that confronts the bottom surface of the battery 28 near the outer peripheral portion thereof, is so constructed that its upper surface 26f, defining the actual battery supporting portion, is located at a level higher than that of the uppermost surface 74f of the wheel train bridge 74. The battery retaining spring 60, however, retains the battery 28 at such a position that the bottom surface thereof is, under normal circumstances, free of contact with the battery receiving member 26 inclusive of the battery supporting surface 26f. That is to say, the battery 28 is retained and attached to the structural members of the timepiece movement by means of the battery retaining spring 60 in such fashion that a clearance ordinarily exists between the battery 28 and underlying members such as the wheel train bridge 74 and battery receiving member 26. This arrangement has been adopted in view of the fact that it constantly prevents the movable portions of the wheel train and the like from receiving an unnecessary load stemming from the weight of the battery 28, which would otherwise ordinarily be borne directly by the wheel train bridge 74 and the like. The arrangement is such that when the timepiece is subjected to an impact force by being dropped, for example, the impact load ascribed to the battery 28 is parried primarily by the upper surface 26f. Specifically, the clearance between the bottom surface of the battery 28 and the upper surface 26f of the battery receiving member 26 is smaller than that between the bottom surface of the negative pole 28a of the battery 28 and the uppermost surface 74f of the wheel train bridge 74. Adopting such an expedient at least permits the upper surface 74 to parry the force of the impact without the battery 28 per se striking the wheel train bridge 74 directly. This prevents accidents such as damage to the wheel train mechanism. In the above arrangement it is also possible to adopt a structure in which the impact load from the battery 28 can be received and absorbed simultaneously by the wheel train covering portion 26a of the battery receiving member 26. In particular, it is preferred that the battery receiving member 26 be formed of a par-soft synthetic resin material in order to better absorb the impact load ascribed to the battery 28.

The next structure to be described will be that for providing the electrical interconnection between the flexible printed circuit board 92 of the electric circuit block 22 and the negative and positive poles 28a, 28b of the battery 28. It was mentioned above that the printed circuit board 92 has the conductive pattern 92a, comprising a thin metal sheet of copper foil or the like, provided on its bottom side. However, portions of the resin sheet body forming the printed circuit board are cut away. This is carried out at those portions of the conductive pattern 92a that are to provide the electrical connections to lead members for the negative and positive poles of the battery, that is, at those portions of the circuit board that are provided with a pattern for connection with the negative pole of the battery 28, and a pattern 95 for connection with the positive pole of the battery 28. Removing the above portions of the circuit board 92 partially exposes the connection patterns 93, 95 to the upper side of the circuit board. For example, the negative pole connection pattern 93 is exposed to the upper side of the circuit board 92 in a hole 92b formed by removing a portion of the synthetic resin sheet constituting the board, and the positive pole connection pattern 95 is exposed to the upper side of the circuit board 92 in a notch 92c formed by removing an edge portion of the synthetic resin sheet. Furthermore, the positive pole connection pattern 95 is disposed along the corner 16n of a recess 16m provided in the main plate 16. On the other hand, a portion of the battery retaining spring 60 is formed to include a resilient arm portion 60e that serves as a positive pole lead for electrically connecting the positive pole 28b of the battery 28 to the positive pole connection pattern 95. The construction is such that the positive pole connection pattern 95 is pressed from above by means of the resilient arm portion 60e to maintain stable contact between it and the positive pole 28b of the battery 28, the result being more reliable electrical contact between the positive pole 28b and the circuit block 22. In addition, a portion of the battery receiving member 26 is formed to include a recess 26h for accommodating a negative pole lead member, that is, for accommodating a negative pole lead spring 89. The spring 89 is retained at a prescribed position by means of a positioning projection 26j provided in a portion of the recess 26h. Specifically, the lead spring 89 is retained at a position where it is sandwiched from above and below by the battery receiving member 26 and the negative pole 28a of the battery in such a manner that one end 89a of the lead spring is brought into resilient pressured contact with the negative pole 28a from therebelow, while the other end 89b of the lead spring is brought into resilient pressured contact with the negative pole connection pattern 93 from thereabove, the connection pattern 93 corresponding to the floor of the hole 92b. Thus, the arrangement is such that the electrical interconnection between the negative pole 28a and the electronic circuit block 22 can be carried out in a reliable manner. This structure therefore makes it possible to expose connection patterns to the upper surface of the printed circuit board 92 easily without providing separate battery connection patterns on the upper surface of the printed circuit board 92 as well and, as a result, without providing throughhole conductive portions or the like for interconnecting connection patterns on the upper surface with conductive patterns on the lower surface. Even the connection between the battery and connection patterns can be accomplished through a very simple structure.

A portion of the battery retaining spring 60 is formed to include also a resilient contactor 60f so constructed as to come into resilient pressured contact with the setting lever 82 from thereabove, the latter forming the portion 20 of the displayed time correction mechanism. The resilient contactor 60f not only regulates the play of the setting lever itself by pressing a portion of the setting lever from above, but also holds the clutch lever 84, serving as a reset lever as well, at the same potential $V_{DDH}$ as that of the positive pole 28b of the battery 28. In other words, since the setting lever 82 and clutch lever 84 are mating with each other as described earlier, it should be obvious that an electrical interconnection is established between the positive pole 28b and the clutch lever 84 when the resilient contactor 60f of the battery retaining spring 60, which is connected to the positive pole 28b, is in contact with the setting lever 82. Further, a reset terminal 39 is formed as a portion of the conductive pattern 92a provided on the bottom side of the printed circuit board 92. When the crown 12 is pulled out by two steps to the position 12a, the clutch lever 84 is brought into contact with the reset terminal 39 so that the latter is coupled to the same potential $V_{DDH}$ as that of positive pole of the battery 28. Thus, in accordance with this arrangement, the reset lever (the clutch lever 84 serving also as the reset lever in this embodiment) carried on the main plate 16 can be held at the potential level of the battery with ease even when the main plate consists of an insulative synthetic resin material. Furthermore, the arrangement is such that the upward displacement of the printed circuit board 92 is regulated by a portion of the battery receiving member 26 in the region where the reset terminal 39 is formed, thereby to assure the connection between the reset terminal and reset lever.

The battery retaining spring 60 is formed to include also a resilient arm 60g for contacting a back cover, which arm is so constructed as to come into resilient pressured contact with a metallic back cover 101. The resilient arm 60g holds the back cover 101, and a metallic case band 103 joined to the back cover, at the potential $V_{DDH}$, thereby to shield the circuit block 22 against static electricity, and to assist in holding the clutch lever 84 at the potential $V_{DDH}$. More specifically, by establishing contact between the case band 103 and setting stem 14, the clutch lever 84 can be held at the potential $V_{DDH}$ through an additional path, namely a path extending from the back cover 101 to the clutch lever 84 via the case band 103, setting stem 14, and clutch wheel 80. Thus, the above path assists in maintaining the clutch lever at the potential $V_{DDH}$ even if the resilient contactor 60f should fail in its function of holding the clutch lever at said potential. Holding the back cover 101 at the potential $V_{DDH}$ will still be highly effective in shielding the electronic circuit block 22 from static electricity even if the case band 103 is composed of a synthetic resin material, and even if the setting stem 14 is insulated from the case band 103 by a waterproof packing made of synthetic rubber.

The battery receiving member 26 is formed to include, adjacent the outer periphery thereof, an engaging portion 26j for engaging a casing ring 105 that serves to retain the timepiece movement at a prescribed position within the case band 103, as shown in FIG. 6B. That is, since the battery receiving member 26 is composed of the comparatively soft synthetic resin material and is retained reliably in the main plate 16 by means of the hook portion 26c mentioned above, adopting a construction in which the battery receiving member 26 is accommodated within the case band 103 via the engaging portion 26j and casing ring 105 permits the timepiece movement to be retained within the case reliably and with facility, and makes it possible to absorb shocks applied to the timepiece movement from outside, the latter being achieved owing to the resiliency stemming from the material properties of the battery receiving member 26 itself. Another possible arrangement that may be devised by considering the case structure is one in which the engaging member 26j itself serves as a casing ring as well, that is, with the engaging portion 26j being so adapted as to engage directly with a portion of the case band.

In the timepiece movement of this embodiment as described above, the greater part of the structural components are so formed as to be covered by the overlying coin-type lithium battery 28. However, the arrangement has been so devised as to permit portions of the timepiece movement to be inspected and adjusted while the movement is operating, and to permit the movement to be simply manipulated without removing the battery 28. For example, the setting lever 82 is provided as the portion 20 of the displayed time correction mechanism, as described above. When extracting the timepiece movement from the case, it is necessary to disengage the setting lever 82 from the setting stem 14 and to withdraw the crown 12 from the timepiece by manipulating the setting lever 82 in a prescribed manner. To this end, in accordance with the timepiece of this embodiment, a manipulation portion 82b is disposed outside of the space occupied by the lithium battery 28 when viewed in plan, the manipulation portion 82b being used to manipulate the setting lever 82 when the crown 12 is withdrawn from the timepiece. This allows the crown 12 to be withdrawn by manipulating the manipulation portion 82b of the setting lever 82 without removing the battery 28, despite the fact that the latter is a coin-type lithium battery occupying a large area. Further, portions of the printed circuit board 92 constituting the electronic circuit block are provided with inspection terminals 97, 99 connected electrically with the output terminals of the motor drive circuit 40 forming a portion of the IC chip 94. The inspection terminals 97, 99 also are disposed outside of the space occupied by the battery 28 when viewed in plan, so that the output waveform of the drive circuit 40 can be inspected without removing the battery 28, that is, while the electronic circuit block 22 is being driven by the battery. Moreover, since the inspection terminals 97, 99 are exposed to the upper side of the printed circuit board 92 in exactly the same manner as the pattern 93 for the connection to the negative pole of the battery, it suffices to bring a terminal of a measuring device or the like into direct contact with the inspection terminals 97, 99 from above the terminals when the inspection operation is carried out. Likewise, the dividing ratio setting terminals 48, 50 mentioned above also are disposed outside of the battery 28 so that the speed of the timepiece can be measured with the battery in place within the movement and while the timepiece is being driven by the battery. In addition, this arrangement permits the speed to be regulated by directly cutting the terminals 48, 50 in accordance with the result of the above measurement. Since the dividing ratio setting terminals 48, 50 also are exposed to the upper side of the printed circuit board 92 in the same manner as the pattern 93 or the like for the connection to the negative pole of the battery, it is possible to readily sever the portions of the conductive pattern that constitute the terminals 48, 50, at such time that the timepiece speed adjustment is carried out.

Numeral 107 denotes a dial, 109 a date indicator maintaining plate, 111 a calendar feed wheel driven by the hour wheel 76 and adapted to drive the day wheel 69 and date wheel 88, and 113 a dial support member. Numeral **86*b* denotes a rivet for fixing the calendar correction lever 86 to the date indicator maintaining plate 109, the head portion of the rivet 86*b* serving to limit the play of the minute wheel 78. Since the coil 42 has its upper surface covered by the battery 28, the coil is sufficiently surrounded, and hence protected, by the main plate 16, date wheel 88, battery receiving member 26 and battery 28 and the like. Moreover, the coin-type lithium battery 28 overlies and covers the greater part of the stepping motor 24 composed of such elements as the coil 42 and stator 62, and the casing of the battery 28 consists of magnetic stainless steel. These two factors allow the battery 28 itself to serve additionally as a magnetic shielding member for the stepping motor 24** so that it is possible to dispense with at least a special magnetic shielding plate that would otherwise be disposed on the back cover side of the timepiece movement.

The IC chip 94 is mounted on the flexible printed circuit board by means of a so-called mini-MOD technique. Specifically, those portions of the IC chip 94 that are bonded to the conductive pattern **92*a* are protected by a potting resin 117 which fills the interior of a resin potting frame 115**.

The displayed time correction mechanism, in accordance with the embodiment described above, is composed of a mechanical correction mechanism comprising the clutch wheel 80, setting lever 82, clutch lever 84 and the like. It should be noted, however, that it is possible to provide displayed time correction means so constructed as to execute the correction of displayed time by, for example, increasing the rate of hand advance through changing over the driving frequency of the stepping motor 24, or by rotating the stepping motor 24 and the hands in the reverse direction through changing over the driving waveform applied to the stepping motor, these operations being performed in accordance with the manipulation of an externally operated switch. In such case the switch contact mechanism and the like would be disposed in the spaces occupied by the clutch wheel 80, setting lever 82 and clutch lever 84, etc.

Further, in the embodiment described above, the main plate 16 is composed of a comparatively hard synthetic resin material, while the battery receiving member is composed of a comparatively soft synthetic resin material. The reason is that the main plate 16 must serve as the fundamental frame-work for construction of the timepiece movement and therefore requires a certain degree of strength, hence the selection of the comparatively hard material. The battery receiving member 26, on the other hand, is provided with portions requiring resiliency, such as the resilient hook portions **26*c* and the engaging portions 26*j* for mating with the casing ring 105**, and with portions that must serve to absorb the impact load received from the battery and the like. Therefore the comparatively soft material is selected. These circumstances accout for the difference in material chosen for the main plate and battery receiving member.

The gist of the present invention as set forth above resides in a structure wherein a main plate consists of a synthetic resin material and a wheel train mechanism is disposed on the main plate at the approximate central portion thereof, and in that use is made of a flexible printed circuit board, only one side of which is provided with a densely arranged electrically conductive pattern, as a circuit board for constructing the electronic circuit block, the printed circuit board being carried directly on the main plate with the side having the electrically conductive printed circuit pattern facing downward. In accordance with the present invention, therefore, the main plate is composed of an insulating material and the flexible printed circuit board serves as the circuit board. Hence, there is absolutely no danger of an electrical short circuit even when the printed circuit board, having the conductive pattern provided densely on its downwardly facing surface, is placed directly on the main plate. Moreover, the printed circuit board, owing to its inherent flexibility, can be disposed in a state that agrees sufficiently with the surface of the main plate. Furthermore, portions of the main plate can readily be formed to include recesses for accommodating and protecting those electrical elements, mounted on the printed circuit board, that project from the lower side thereof, that is, those portions of the elements that project toward the main plate. Adopting such an arrangement eliminates the need for interposing any special insulating members or electrical element protecting members between the printed circuit board and the main plate. In addition, since the flexible printed circuit board can be placed on the upper surface of the main plate in an intimately contacting state and in sufficient shape-wise agreement therewith, the structure is such that the printed circuit board is reinforced sufficiently by the main plate. The result is a structure equivalent to that which would be obtained by employing a thick and mechanically strong material for the printed circuit board, without requiring the addition of special reinforcing members. An advantage also is found when portions of the conductive pattern provided on the printed circuit board are to be connected electrically to other members. By removing only a portion of the resin sheet (body portion) constituting the printed board, it becomes possible to expose the conductive pattern at this portion to the upper side of the printed board. Doing so allows the other members to be brought into contact with the exposed pattern from thereabove, so that the electrical interconnection can be effected with ease. In such case, the conductive pattern is supported strongly from below by the main plate in order to maintain a stable electrical interconnection despite the contacting pressure, namely the pressing force, which the other members exert upon the conductive pattern. The main plate, therefore, absorbs the pressing force, and no special connectors or fixing members or the like need be added to maintain the stability of the electrical interconnection.

It is also noteworthy that at least a portion of the printed circuit board is pressed from above by such members as the synthetic resin battery receiving member and the wheel train bridge, providing a structure wherein the printed circuit board is embraced from above and below by these members and by the main plate. Adopting such a structure enables the electronic circuit block to be reliably and rigidly retained within the timepiece movement, making it possible to sufficiently improve the impact resistance of the electronic circuit block.

What is claimed is:

1. An analog-type electronic wristwatch structure comprising;

a main plate made of an insulating materia and having one side including a first area formed with a cutout, and second and third areas;

a wheel train bridge secured to one side of said main plate above said cutout to form therein a space;

a wheel train mechanism disposed in said space;

a flexible circuit board disposed in the second area of said main plate and having its lower surface facing said main plate, said lower surface being provided with a printed circuit pattern said flexible circuit board carrying electronic components composed of at least a time base vibrator and an IC chip;

an electromechanical transducer drive coil disposed in the third area of said main plate;

a flat battery disposed over said wheel train mechanism, said flexible circuit board and said electromechanical transducer drive coil;

a flat battery support member made of a synthetic resin and fixed to the one side of said main plate to support said flat battery and to press said flexible circuit board directly to said main plate in the area where said printed circuit pattern is formed; and a battery retaining spring secured to said main plate;

said main plate and said flat battery support member having recesses for accommodating at least portions of said electronic components.

2. An analog-type electronic wristwatch according to claim 1, in which said printed circuit pattern is formed of a thin metal sheet, and in which said printed circuit board has a power supply battery connection pattern connected to said printed circuit pattern, a part of said printed circuit board being removed at a portion where said power supply battery connection pattern is provided, thereby to partially expose said power supply battery connection pattern to an upper side of said printed circuit board, and in which said battery retaining spring has a resilient arm serving as a positive pole lead, said battery retaining spring being held in electrical contact with a positive pole of said battery, and said resilient arm being held in electrical contact with said power supply battery connection pattern of said flexible circuit board.

3. An analog-type electronic wristwatch according to claim 2, in which said resilient arm of said battery retaining spring extends into a cutout formed in close proximity to an outer periphery of said flat battery support member so as to be held in electrical contact with said power supply connection pattern.

4. An analog-type electronic wristwatch according to claim 2, further comprising a negative pole lead spring accomodated in a recess formed in a part of said flat battery support member, said negative pole lead spring being held in electrical contact with a negative pole of said battery and said power supply battery connection pattern of said flexible circuit board.

5. An analog-type electronic wristwatch according to claim 1, in which said main plate has a recess formed adjacent said power supply battery connection pattern, said power supply battery pattern being exposed at a corner of said recess.

6. An analog-type electronic wristwatch according to claim 1, in which said IC chip has a frequency divider circuit, and said flexible circuit board has dividing ratio setting terminals, for regulating a dividing ratio of the frequency divider circuit, a part of said printed circuit board being removed at portions where said dividing ratio setting terminals are provided, thereby to partially expose said dividing ratio setting terminals to an upper side of said flexible circuit board.

7. An analog-type electronic wristwatch according to claim 1, in which said IC chip has a timepiece circuitry, and said printed circuit board has inspection terminals, for inspecting at least a portion of said timepiece circuitry, a part of said printed circuit board being removed at portions where said inspection terminals are provided, thereby to partially expose said inspection terminals to an upper side of said flexible circuit board.

* * * * *